US010497342B2

(12) United States Patent
Oberg

(10) Patent No.: US 10,497,342 B2
(45) Date of Patent: Dec. 3, 2019

(54) SADDLE/BRIDGE ASSEMBLY FOR STRINGED MUSICAL INSTRUMENTS

(71) Applicant: Robert L. Oberg, Syosset, NY (US)

(72) Inventor: Robert L. Oberg, Syosset, NY (US)

( * ) Notice: Subject to any disclaimer, the term of this patent is extended or adjusted under 35 U.S.C. 154(b) by 0 days.

(21) Appl. No.: 15/958,874

(22) Filed: Apr. 20, 2018

(65) Prior Publication Data

US 2019/0035367 A1 Jan. 31, 2019

Related U.S. Application Data

(63) Continuation-in-part of application No. 15/852,127, filed on Dec. 22, 2017, which is a continuation-in-part of application No. 15/659,438, filed on Jul. 25, 2017, now Pat. No. 9,978,346, application No. 15/958,874, which is a continuation-in-part of application No. 15/659,438, filed on Jul. 25, 2017, now Pat. No. 9,978,346.

(51) Int. Cl.

| | |
|---|---|
| ***G10D 3/04*** | (2006.01) |
| ***G10H 3/18*** | (2006.01) |
| ***G10D 1/00*** | (2006.01) |

(52) U.S. Cl.

CPC ..... *G10D 3/04* (2013.01); *G10D 1/00* (2013.01); *G10H 3/18* (2013.01); *G10H 3/185* (2013.01); *G10H 2220/471* (2013.01)

(58) Field of Classification Search

CPC ..... G10D 3/04; G10D 3/00; G10H 2220/471; G10H 2220/525; G10H 1/32; G10H 2220/485; G10H 3/181; G10H 2220/495; G10H 2220/465; G10K 11/004

See application file for complete search history.

(56) References Cited

U.S. PATENT DOCUMENTS

| | | | | |
|---|---|---|---|---|
| 5,750,910 A * | 5/1998 | LoJacono | G10D 3/04 | 84/314 N |
| 5,955,694 A * | 9/1999 | Sakurai | G10H 3/185 | 84/743 |
| 6,031,165 A * | 2/2000 | Brekke | G10D 3/04 | 84/298 |
| 6,166,309 A * | 12/2000 | Hoshino | G10D 3/04 | 84/298 |
| 6,613,968 B1 * | 9/2003 | Devereaux | G10D 3/04 | 84/298 |
| 6,706,957 B1 * | 3/2004 | Merkel | G10D 3/12 | 84/314 N |

(Continued)

*Primary Examiner* — Marlon T Fletcher

(74) *Attorney, Agent, or Firm* — Scarinci Hollenbeck, LLC; Libby Babu Varghese

(57) ABSTRACT

A saddle assembly for a stringed musical instrument comprising a saddle footing having a body of any desired geometry and a surface curvature compatible with and conforming to the surface curvature of the soundboard of the stringed musical instrument upon which the body of the saddle footing is mounted with or without the use of a bridge plate, with the saddle footing adapted to accommodate either a conventional bridge or conventional saddle for elevating the strings in the stringed musical instrument relative to the soundboard or upon which a modified bridge or modified saddle is mounted having a geometry which conforms in geometry and curvature to the geometry and curvature of the elongated slot in the saddle footing.

20 Claims, 5 Drawing Sheets

(56) References Cited

U.S. PATENT DOCUMENTS

| | | | | |
|---|---|---|---|---|
| 2003/0172793 | A1* | 9/2003 | Hori | G10H 3/185 84/298 |
| 2005/0188814 | A1* | 9/2005 | Bell | G10D 1/00 84/298 |
| 2006/0117938 | A1* | 6/2006 | Gillette | G10H 3/185 84/723 |
| 2014/0165821 | A1* | 6/2014 | Hughes | G10H 3/181 84/724 |
| 2018/0025705 | A1* | 1/2018 | Oberg | G10H 1/32 84/731 |
| 2019/0035367 | A1* | 1/2019 | Oberg | G10D 1/00 |

* cited by examiner

SADDLE/BRIDGE ASSEMBLY FOR STRINGED MUSICAL INSTRUMENTS

The present invention is a continuation in part of U.S. patent application Ser. No. 15/852,127, filed on Dec. 22, 2017 and a continuation in part of U.S. patent application Ser. No. 15/659,438 filed on Jul. 25, 2017, both of which are incorporated herein by reference, and relate more particularly to a saddle/bridge assembly, hereinafter simply referred to as a saddle assembly, the preferred embodiment of which, can be universally used with any stringed musical instrument, inclusive of a violin, cello, bass violin, guitar, ukulele and banjo, for supporting the strings at an elevated position above the sound board of the musical instrument, enhancing and resonating the transmission of sound from the vibration of the strings and providing sound transmission via a conventional transducer pick up incorporated within the saddle assembly. U.S. application Ser. No. 15/852,127 is itself a continuation in part of U.S. application Ser. No. 15/659,438.

FIELD OF THE INVENTION

Background of the Invention

A stringed musical instrument employs structural support means such as a saddle and/or bridge to support the strings at a given elevation above the sound board of the musical instrument depending upon the type of stringed musical instrument being played. For a guitar and ukulele a saddle is conventionally used to support the strings at one given elevation with respect to the soundboard whereas in a violin, cello, bass violin and banjo a bridge is conventionally used to support the strings at another preferred elevation above the soundboard. The sound board of the stringed musical instrument corresponds, in general, to the anatomical front board of the musical instrument. However, as taught in corresponding U.S. patent application Ser. No. 15/659,438, the anatomical front board and the anatomical rear board of a musical instrument may be simultaneously used as sound boards for the musical instrument. To use the anatomical front board and the anatomical rear board simultaneously, a bridge plate is mounted on both the front and rear sound boards of e.g., an acoustical guitar with only a single set of strings strung through the interior body of the guitar over a saddle in a bridge plate mounted on each of the two sound boards. The saddle may have a conventional transducer pick up incorporated in the body of the saddle. Sound is transferred from a soundboard in the stringed musical instrument to the atmosphere through sound openings, referred to herein as "ports", which in a violin, violin bass and cello are conventionally identified as "f-holes" and in a conventional guitar and ukulele conventionally identified as a sound hole.

A common requirement for all stringed musical instruments is the need to continually readjust string tuning during play to correct intonation and tuning. This is partially attributable to the limited contact surface area provided between a conventional bridge and soundboard in a violin, bass violin, cello and banjo and to the limited contact surface area between a conventional saddle and bridge plate mounted on the soundboard of a guitar and ukulele respectively. The saddle assembly of the present invention comprises a saddle footing which enlarges the contact surface area between the bridge or saddle and the soundboard in all stringed musical instruments and the surface area on the soundboard in contact with the bridge or saddle and bridge plate which increases sonic transmission. As a result, the saddle assembly of the present invention improves the accuracy of intonation and tuning by alleviating any tendency of the bridge or saddle to bend during play thereby holding the strings at a given tension for longer periods of time during play relative to the use of a conventional bridge and/or saddle which typically bends causing detuning and inaccurate intonation.

In addition, the preferred embodiment of the saddle footing in the saddle assembly of the present invention is universally applicable, with appropriate size modification, to all stringed musical instruments. The saddle footing in the saddle assembly of the present invention will accommodate the use of either a conventional bridge or a conventional saddle for supporting the strings in a stringed musical instrument at an elevated position relative to the soundboard and will accommodate the use of a modified bridge and/or modified saddle to provide greater control for supporting the strings and for enhancing sound transmission from the strings through the saddle assembly.

To enhance and amplify sound transmission, the saddle assembly of the present invention may further comprise a conventional transducer pick up integrated into the body of the saddle footing and/or integrated in the body of a modified bridge and/or modified saddle for use with the saddle footing in the saddle assembly of the present invention and further comprises wire cables incorporated in the saddle assembly and/or in the modified bridge and/or modified saddle to facilitate the transmission of electrical signals generated from a transducer pick up in the saddle assembly and/or in the modified bridge and/or saddle to one or more preamplifier(s) or amplifier(s) in the stringed musical instrument.

The use of a modified bridge and/or a modified saddle is preferred to the use of a conventional bridge and/or conventional saddle in the saddle assembly of the present invention in that the modified bridge and/or modified saddle provides greater contact surface area engagement to the saddle footing increasing structural support and sonic enhancement between the strings and the soundboard of the musical instrument. Moreover, the modified bridge and modified saddle, used with the saddle footing in the saddle assembly of the present invention, may include a conventional transducer pick up integrated into the body of the modified bridge or modified saddle to permit direct conversion of string vibrations into electrical signals which can be transmitted at a reduced signal to noise ratio from the transducer pick up to a preamplifier or amplifier. In addition, when the saddle assembly of the present invention incorporates one or more conventional transducer pick up's the saddle assembly transforms a conventional stringed musical instrument such as a violin, bass violin and cello into an electric counterpart thereof.

SUMMARY OF THE INVENTION

The saddle assembly of the present invention comprises a saddle footing having a body of any desired geometry and a surface curvature compatible for mounting the body of the saddle footing onto a soundboard of a violin, bass violin, cello, arch type semi-hollow guitars or a banjo or for inserting the body of the saddle footing into a bridge plate mounted on a soundboard of a guitar or ukulele. A preferred embodiment of the saddle footing in the saddle assembly of the present invention includes an elongated slot adapted to accommodate the insertion of a conventional bridge or a conventional saddle for elevating the strings in the stringed musical instrument relative to the soundboard thereof or may alternatively accommodate the insertion of a modified bridge or modified saddle for use with the saddle footing in the saddle assembly of the present invention to elevate the strings to a predetermined height relative to the soundboard. As a further alternative, the saddle footing in the saddle assembly of the present invention may function directly as a bridge plate to be mounted on a soundboard of a stringed musical instrument, particularly a conventional semi-hollow guitar, and may have a body upon which a modified saddle may be mounted for elevating the strings relative to the soundboard. In this case, the saddle footing may include adjustable thumb wheels as well as shims for elevating support posts in the modified saddle mounted thereon to raise or lower the elevation of the strings in the guitar and to adjust for proper fretboard height.

The body of the saddle footing in the saddle assembly of the present invention has a surface curvature conforming to the surface curvature of the soundboard in the respective stringed musical instrument upon which it is directly or indirectly mounted or connected.

The modified bridge, modified saddle and saddle footing in the saddle assembly of the present invention may each have a body including a conventional transducer pick up integrated therein. However, the body of the modified saddle for use with the preferred saddle footing of the present invention preferably comprises a geometry having a "T" configuration in cross section independent of whether a conventional transducer pick up is integrated in the body of the modified saddle.

The saddle assembly of the present invention may further comprise a shim as a component thereof for placement between the saddle footing in the saddle assembly of the present invention and a bridge plate, mounted upon the soundboard of the guitar or ukulele, to provide for height adjustment of the saddle assembly relative to the bridge plate.

The saddle assembly of the present invention includes a saddle footing which may be universally used, when adjusted for size, in any stringed musical instrument inclusive of a violin, bass violin, cello, banjo, guitar and ukulele for elevating the strings relative to the soundboard of the stringed musical instrument. The saddle footing must be sized for compatibility with the size of the stringed musical instrument with which it is to be used and must have a surface curvature conforming to either the flat or arched surface curvature of the soundboard of the stringed musical instrument in which it is to be used.

The saddle assembly of the present invention may be used in any stringed musical instrument which may include additional features such as having one or more sound ports in addition to the presence of a sound hole for use in a conventional stringed musical instrument such as a guitar and ukulele and in addition to the "f" sound holes present in a conventional violin, bass violin, cello and arch top guitars. The stringed musical instrument may also include curved or flat dividers for use within the body of a hollow or semi-hollow musical instrument for providing additional structural support between the soundboard and the body of the musical instrument. The above features inclusive of the addition of one or more sound ports and the incorporation of curved or flat dividers are taught and explained in greater detail in applicants corresponding U.S. patent application Ser. No. 15/852,127 filed on Dec. 22, 2017 the specification of which is incorporated herein by reference.

BRIEF DESCRIPTION OF THE DRAWINGS

Other advantages of the subject invention will become apparent from the following detailed description of the invention when read in conjunction with the accompanying drawings of which.

DETAILED DESCRIPTION OF THE INVENTION

Figure 1:
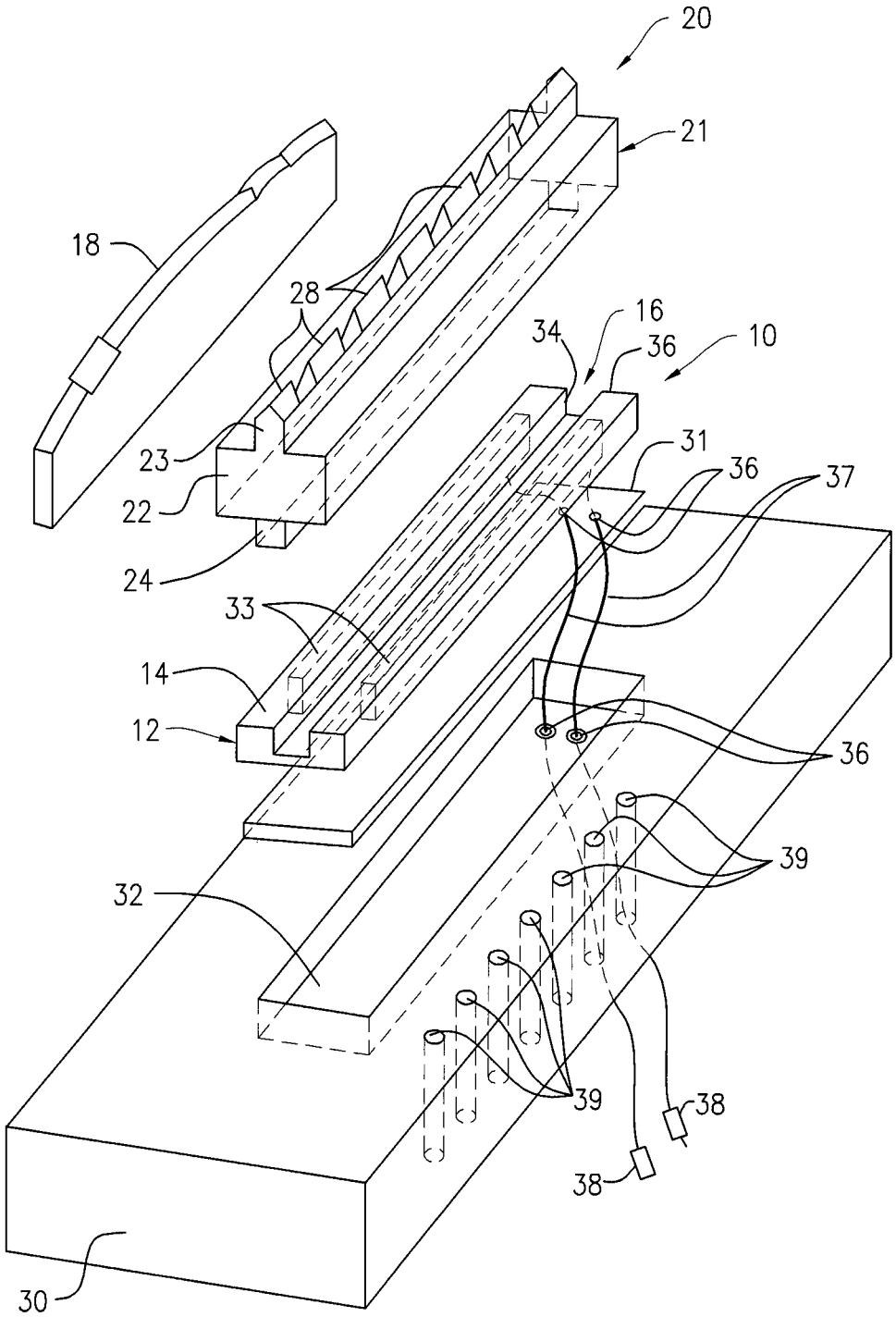
FIG. 1 is an exploded perspective view of the saddle assembly of the present invention for use in a stringed musical instrument such as a guitar or ukulele comprising a saddle footing which, in its preferred embodiment, includes an elongated slot adapted to receive either a conventional saddle or a modified saddle for insertion into a bridge plate adapted to be mounted on the soundboard of the guitar or ukulele with the modified saddle having a body into which one or more conventional transducer pick up's are integrated and with the saddle assembly further comprising at least one shim as an optional component thereof.

The saddle assembly 10 of the present invention for use in a stringed musical instrument is shown in FIG. 1 comprising a saddle footing 12 having a body 14 of any desired geometry, preferably a rectangular geometry, which, in its preferred embodiment, includes an elongated slot 16 extending from each opposite end of the body 14 into which a conventional saddle 18 or a modified saddle 20 is placed. The slot 16 in the saddle footing 12 has a geometry which conforms, in cross section, to the geometry of the conventional saddle 18. The modified saddle 20 has a body 21 which includes a central section 22, an upper section 23 and a lower section 24 which extend from opposite ends of the central section 22. The upper and lower sections 23, 24 of the modified saddle 20 are much smaller in width relative to the width of the central section 22 such that the central section 23 and the lower section 24 form a configuration, in cross section, which conforms to the shape of the letter "T". The lower section 24 of the modified saddle 20 has a geometry and dimensions which conform to the geometry and dimensions of the slot 16 so that a tight fit occurs when the lower section 24 of the modified saddle 20 is inserted into the slot 16 of the saddle footing 12.

The upper section 23 of the modified saddle 20 is divided into a multiple number of spaced apart members 28, shaped in the form of posts, extending from the central section 22 and conforming in number to the number of strings in the guitar or ukulele into which the saddle assembly 10 is mounted for supporting the strings at a given elevated height above the soundboard of the musical instrument.

The saddle footing body 14 is adapted to be mounted directly on the soundboard of a violin, bass violin, cello or banjo or is alternatively inserted into a bridge or bridge plate 30 adapted to be mounted on or in the soundboard of a conventional guitar or ukulele. The bridge plate 30 has an internal slot 32 adapted to receive the saddle footing 12. The width of the slot 32 in the bridge plate 30 is preferably enlarged so that it conforms in dimension to the width of the body 14 of the saddle footing 12 so as to provide a relatively large surface area of engagement between the saddle footing 12 and the bridge plate 30 upon insertion of the saddle footing 12 into the slot 32 of the bridge plate 30. The geometry of the body 14 of the saddle footing 12 should conform to the geometry of the internal slot 32 to create a tight fit between the saddle footing 12 and the slot 32 in the bridge plate 30.

The saddle footing 12 preferably includes one or two conventional transducer pick up's 33 which are integrated within the body 14 of the saddle footing 12 on the opposite sides 34 and 35 of the elongated slot 16 in the saddle footing 12. In addition, electrical cables 37 which have jacks 38 are attached to each of the transducer pick up's 33 and preferably extend through openings 36 in the internal slot 32 of the bridge plate 30. The bridge plate 30 includes openings 39 through which the strings of the musical instrument are strung.

Figure 2A:
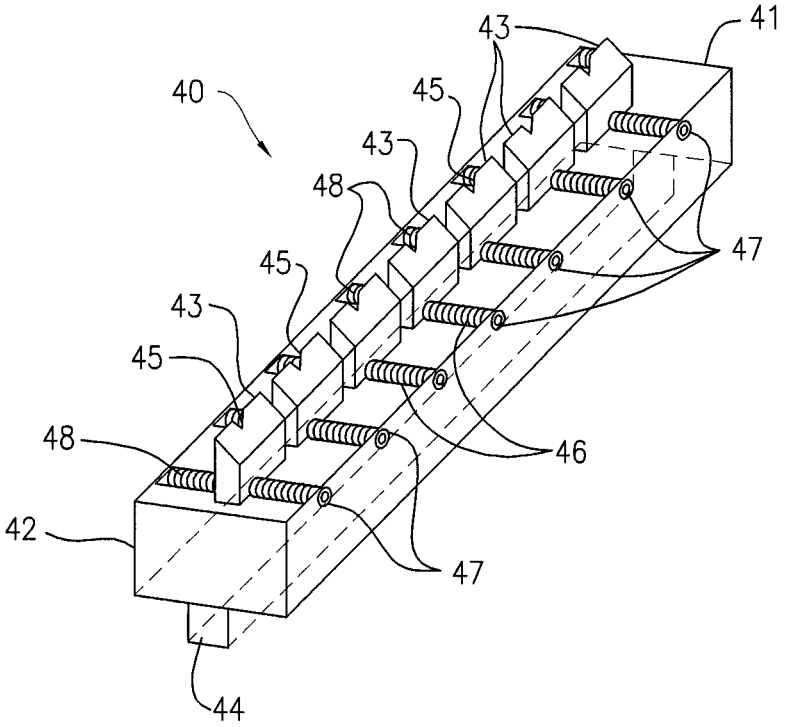
FIGS. 2*a*-2*b* are alternative perspective views of modified saddles for use with the preferred saddle footing embodiment shown in FIG. 1 with the modified saddle in both FIGS. 2*a*-2*b* possessing a body having a "T" configuration in cross section but with the modified saddle in FIG. 2*a* having a plurality of upper members spaced apart from one another for holding the strings of the musical instrument and with the modified saddle in FIG. 2*b* having only one upper member having a pyramid geometry for holding the strings of the musical instrument.
Figure 2B:
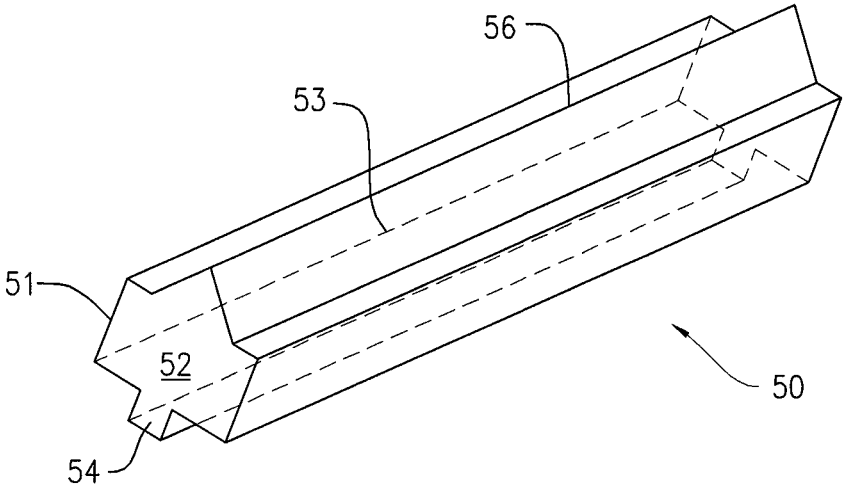

The saddle assembly 10 may further comprise at least one shim 31 for placement into the internal slot 32 of the bridge plate 30 to increase the height of the saddle assembly 12 by increasing the height which the saddle 18 or modified saddle 20 projects from the internal slot 32 of the bridge plate 30. This provides some control to the user of the musical instrument for adjusting the elevated height of the strings relative to the level of the soundboard in the stringed musical instrument. The body 14 of the saddle footing 12 may also be sanded down to lower the height of elevation of the strings relative to the level of the soundboard in the stringed musical instrument FIGS. 2*a* and 2*b* are perspective views showing alternative embodiments of modified saddles for use with the saddle footing 12 in the saddle assembly 10 of the present invention shown in FIG. 1. FIG. 2*a* shows an alternative modified saddle 40 having a body 41 which includes a central section 42, a lower section 44 and a plurality of upper members 43 each of which are mounted on the central section 42 of the saddle body 41. The upper members 43 are separated from one another to form support posts to support the strings of the musical instrument. Each upper member 43 is mounted upon and connected to a manually adjustable gear 46 threadably associated with each of a plurality of threaded openings 47 which extend along the width of the central section 42 at the top end thereof to permit the position of each upper member 43 to be laterally adjusted relative to the central section 42. This allows for precise length adjustment of each string for tuning the intonation of each string independent of each other.

Each of the upper members 43 and the lower section 44 of the modified saddle 40 have a width which is much smaller in dimension relative to the width of the central section 42 so that the combination of the central section 42 and lower section 44 of the modified saddle 40 form, in cross section, a configuration equivalent in shape to the letter "T", with the lower section 44 of the modified saddle 40 having a geometry conforming in geometry and dimensions to the geometry of the slot 16 in the saddle footing 12 to create a tight fit when the modified saddle 40 is inserted into the saddle footing 12. In addition each upper member 43 of the modified saddle 40 has an upper end 48 which has a pyramid shaped geometry which includes a cut out notched section 45 upon which each of the strings of the musical instrument rest.

FIG. 2*b* shows another alternative modified saddle 50 for the saddle footing 12 in the saddle assembly 10 of the present invention shown in FIG. 1 having a body 51 which includes a central section 52, a lower section 54 which extends from the central section 52, and having an upper section 53 extending from the central section 52 with the upper section 53 having a triangular shape in cross section and forming an apex 56 upon which each of the strings of the musical instrument rest. The width of the lower section 54 and the width of the upper section 53 are much smaller in comparison to the width of the central section 52 so that the central section 52 in combination with the lower section 54 forms, in cross section, a configuration having the shape of the letter "T" with the geometry of the lower section 54 conforming in geometry and dimensions to the geometry and dimensions of the slot 16 in the saddle footing 12. It should be understood that the upper section 53 may comprise a plurality of separate pyramid shaped posts as shown in the modified saddle 20 in FIG. 1.

Figure 3:
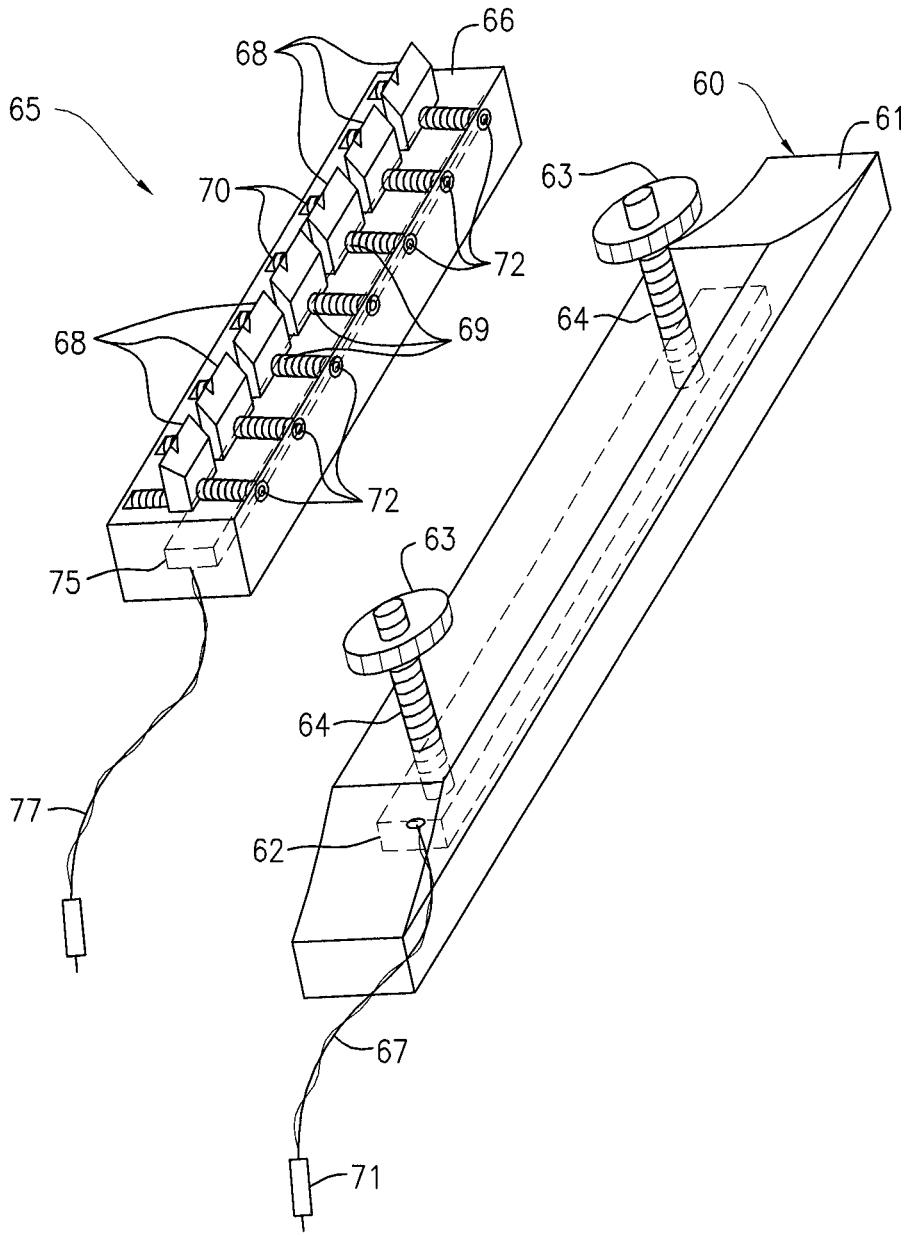
FIG. 3 shows an exploded view of an alternative saddle assembly of the present invention comprising a saddle footing having a body which functions directly as a bridge plate for a soundboard of a stringed musical instrument, particularly a conventional semi-hollow guitar, with the saddle footing including adjustable thumb wheels and with the saddle assembly further comprising a modified saddle adapted to be mounted on the thumbwheels extending from the saddle footing with the modified saddle having a body including a plurality of support members for supporting the strings in the musical instrument, with the height of the support members above the soundboard of the musical instrument being adjustable for adjusting the height of elevation of the strings by manually adjusting the thumbwheels in the saddle footing.

FIG. 3 is an exploded view of an alternative saddle assembly of the present invention comprising a saddle footing 60 having a body 61 adapted to be directly mounted on the soundboard of a musical instrument particularly the soundboard of a conventional semi-hollow guitar, in which case the saddle footing 60 functions as that of a conventional bridge plate when directly mounted on or in the soundboard of the musical instrument. The curvature of the body 61 should conform to the curvature of the soundboard upon which it is to be mounted. The body 61 of the saddle footing 60 may be substantially rectangular in geometry or may be configured into any other desired shape and size and may comprise two thumb wheels 63 fixedly mounted on two externally threaded posts 64 which threadably engage corresponding threaded openings in the body 61 of the saddle footing 60 with the posts 64 vertically extending from the upper surface 74 of the saddle footing 60. A conventional transducer pick up 62 may be integrally incorporated within the body 61 of the saddle footing 60 with a wire cable 67 extending therefrom. The wire cable 67 may have a jack 71 for connecting the transducer pick up 62 to a preamplifier or amplifier in the musical instrument.

The saddle assembly of FIG. 3 further comprises a modified saddle 65 adapted to be mounted directly into the elongated slot 16 of the saddle footing 12 of the saddle assembly shown in FIG. 1 representing a modified version thereof or alternatively mounted upon or directly connected to the support posts 64 extending from the saddle footing 60 for forming an alternative saddle assembly of the present invention. The modified saddle 65 comprises a body 66 including a plurality of support members 68 separated from one another to form support posts for supporting the strings of the musical instrument at an elevated position above the soundboard in the stringed musical instrument. Each upper member 68 is mounted upon or connected to a manually adjustable gear 73 threadably associated with each of a plurality of threaded openings 72 which extend along the width of the body 66 to permit the position of each upper member 68 to be laterally adjusted relative to body 66 of the modified saddle 65 in the same manner as the plurality of upper members 42 are laterally adjusted in the modified saddle 40 in FIG. 2*a*. The height of all of the support members 68 above the soundboard of the musical instrument may be manually adjusted by manually turning the thumbwheels 63 in the saddle footing 60. Accordingly, this allows for precise length adjustment of the strings independent of one another and for height adjustment of all the strings relative to the soundboard for accurate intonation tuning of the strings.

Figure 4:
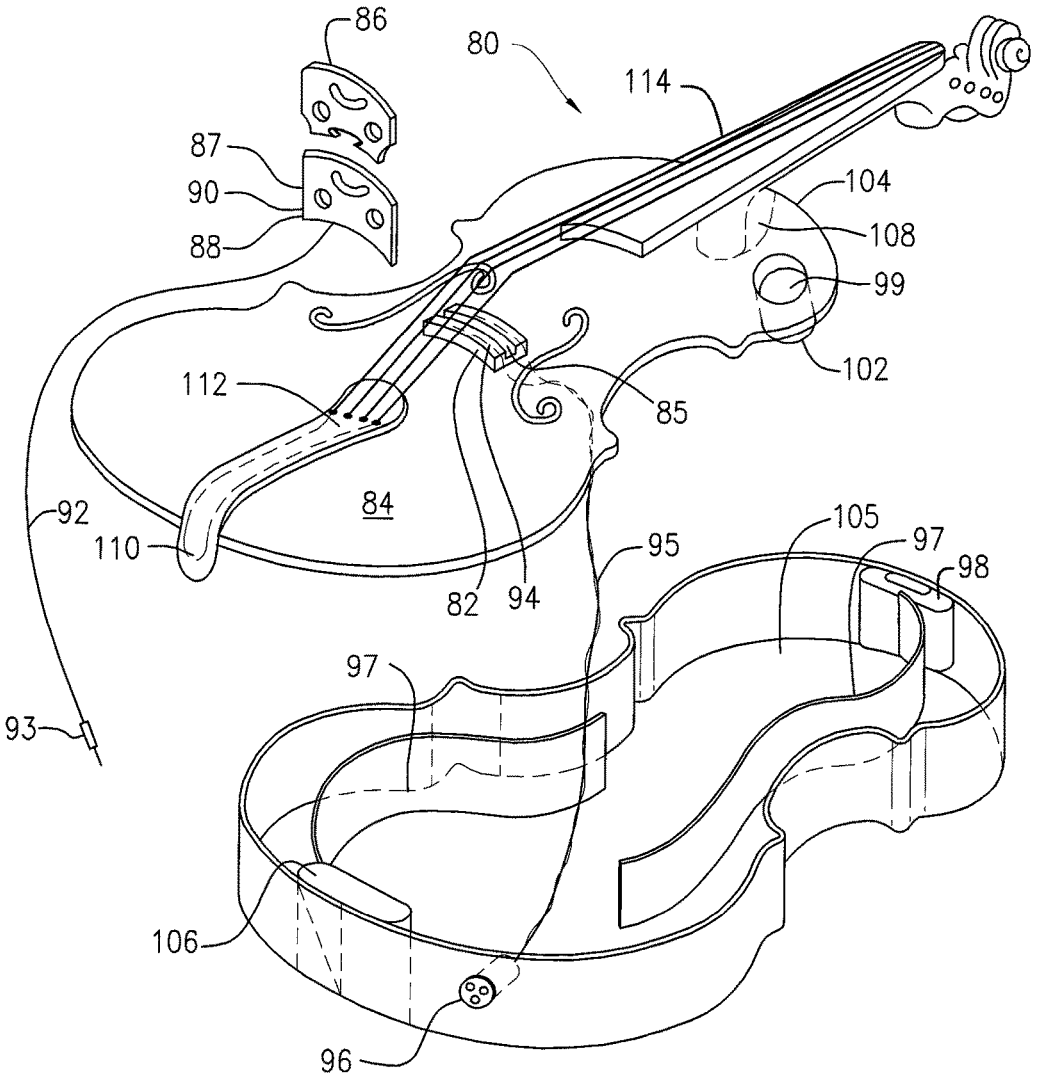
FIG. 4 is an exploded perspective view of the saddle assembly of the present invention for use in a violin, bass violin, cello and banjo with the saddle assembly comprising a saddle footing, having an elongated slot substantially equivalent to the saddle footing shown in FIG. 1, adapted to receive either a conventional bridge or a modified bridge with the modified bridge having a surface curvature compatible with the surface curvature of the saddle footing in which it is to be mounted, and having, in the preferred embodiment thereof, a conventional transducer pick up integrated into the body of the modified bridge and showing in FIG. 4 an artist rendition of a violin having a soundboard upon which the saddle assembly is adapted to be mounted with the violin having a body which includes additional features for use selectively or in combination with the saddle assembly of the present invention.

An exploded perspective view of a violin 80 employing the saddle assembly of the present invention is shown in FIG. 4 with the saddle assembly comprising a saddle footing 82 which is substantially identical to the saddle 12 shown in FIG. 1 for use with a guitar and ukulele. The saddle footing 82 is mounted directly on the soundboard 84 of the violin 80 at a location preferably between the two "f" holes on opposite sides of the violin 80. It should be understood that the saddle footing 82 may similarly be mounted directly on the soundboard of a conventional bass violin or cello although the dimensions of the saddle footing 82 should preferably be sized to account for the relatively substantial difference in size between a violin and a bass violin or cello respectively.

The saddle footing 82 has an elongated slot 85 adapted to receive either a conventional violin bridge 86 or a modified violin bridge 87. The modified violin bridge 87 has a solid base 88 at the bottom end of the bridge 87 to provide additional engagement and surface area between the modified bridge 87 and the saddle footing 82 upon insertion of the modified bridge 87 into the saddle footing 82. In addition the modified saddle 87 may include a conventional transducer pick up 90 integrated therein with a wire cable 92 extending therefrom having a jack 93 at the end of the wire cable 92 for connecting the transducer pick up 90 to a preamplifier or amplifier either in the violin or external thereto. Likewise, the saddle footing 82 may have a conventional transducer pick up 94 integrated into the body of the saddle footing 82 similar to integration of the transducer pick up 33 in the body 14 of the saddle footing 12 of the saddle assembly 10 shown in FIG. 1. A wire cable 95 would extend from the conventional transducer pick up 94 and be connected to a jack 96 in the body of the violin 80.

The violin 80 should preferably include at least one sound port 99 as shown in FIG. 4 which is preferably located in the anatomical front soundboard 84 of the violin 80. The sound port 99 should be constructed as taught in applicants corresponding patent application Ser. No. 15/659,438 the description of which is incorporated herein by reference. The sound port 99 should preferably comprise a geometry which is either parabolic or cylindrical such as that a hollow tube 102 which is adapted to be inserted through an opening formed in the soundboard 84 at the end of the violin 84 adjacent the upper bout 104 with the opening essentially equal in dimension and diameter to the diameter of the tube 102 so that the tube 102 tightly engages the opening in the soundboard 84 when inserted therein. The hollow tube 102 should extend to within the interior 105 of the body of the violin 80. The sound port 99 can be separately tuned to any desired frequency range proportional to the resonant frequency of the violin. Although only one sound port 99 is shown additional sound ports may be added and located within the violin 80 either in the front soundboard 84 or the rear board or in either the upper bout 104 or any of the other sides of the violin 80. It should be understood that one or more sound ports 99 may also be included into any other stringed musical instrument including a bass violin, cello, guitar or ukulele in which the saddle assembly 10 of the present invention is included. The use of one or more sound ports 99 in the stringed musical instrument improves the quality of the sound particularly by increasing the frequency range of the generated sound through the musical instrument.

The violin 80 should also preferably include one or more panels 97 each preferably having a curved serpentine like geometry substantially in the shape of the letter "S" as shown in FIG. 4 or may include geometrically straight i.e. flat panels, as taught in applicants corresponding application Ser. No. 15/659,438. The curved panels 97 are mounted within the interior 105 of the violin 80 and extend from the top block 98 and the bottom block 106 at each opposite end of the violin 80 toward the middle of the violin 80 with each panel 97 aligned relatively close to the opposite sides of the violin 80. The soundboard 84 of the violin 80 is mounted over the body of the violin 80 so that member 108 which extends from the fingerboard 114 fits into the top block 98 and that member 110 which protrudes from the tailpiece 112 fits into the bottom block 106 of the body of the violin respectively. The curved panels 97 permit sound to be funneled or vented toward the sound ports 99 and function as sound posts in addition to proving structural support.

Figure 5:
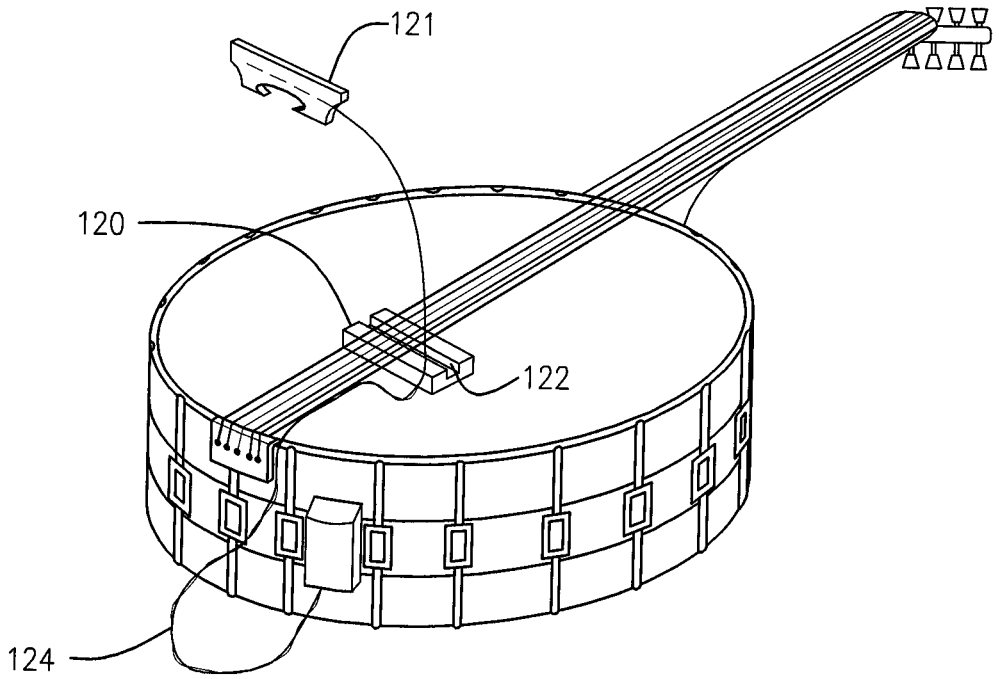
FIG. 5 is an exploded perspective view of the saddle assembly of the present invention for use in a banjo comprising a saddle footing, substantially equivalent to the preferred embodiment of the saddle footing shown herein in FIGS. 1 and 4, and having an elongated slot adapted to receive either a conventional bridge or a modified bridge having a body equivalent to the body of the modified bridge shown in FIG. 4 and preferably including a conventional transducer pick up integrated into the body of the modified bridge.

FIG. 5 shows a saddle footing 120 for the saddle assembly of the present invention similar to FIG. 4 but mounted on the soundboard of a banjo. Likewise the saddle footing 120 may incorporate a conventional transducer pick up 122 with a cable wire 124 for transmitting the electrical signals generated by the conventional transducer pick up 122 to a preamplifer or amplifier in the banjo or external thereto.

What is claimed is:

1. A saddle assembly for a stringed musical instrument comprising a saddle footing having a body of any desired geometry and a surface curvature compatible with and conforming to the surface curvature of the soundboard of the stringed musical instrument upon which the body of the saddle footing is mounted without the use of a bridge plate, with the saddle footing comprising an elongated slot adapted to accommodate either a bridge or a saddle, wherein at least one conventional transducer pick up is incorporated in the body of the saddle footing.

2. A saddle assembly as defined in claim 1 wherein a wire cable extends from each transducer pick up which is adapted to transfer electrical signals, generated from the transducer pick up, corresponding to the vibrations from plucking the strings in the stringed musical instrument, to a pre-amplifier or amplifier.

3. A saddle assembly as defined in claim 1 wherein the saddle footing is mounted with the use of a bridge plate.

4. A saddle assembly as defined in claim 1 wherein said bridge or said saddle is conventional, wherein said conventional bridge or said conventional saddle elevates the strings in the stringed musical instrument relative to the soundboard.

5. A saddle assembly as defined in claim 1 wherein the saddle footing includes two conventional transducer pick ups, each said pick up is incorporated within the body of the saddle footing on opposite sides of the elongated slot in the saddle footing.

6. A saddle assembly as defined in claim 1 wherein said bridge or said saddle is modified, said modified bridge or said modified saddle each has a geometry which conforms in geometry and curvature to a geometry and curvature of the elongated slot in the saddle footing.

7. A saddle assembly as defined in claim 6 wherein the modified bridge or modified saddle comprises a body which includes at least a conventional transducer pick up incorporated therein and comprises a wire cable extending from the transducer pick up for transferring electrical signals generated from the transducer pick up, corresponding to the vibrations from plucking the strings in the stringed musical instrument, to a pre-amplifier or amplifier.

8. A saddle assembly as defined in claim 6 in which the modified saddle comprises a body having a central section and a lower section with the width of the central section being substantially larger than the width of the lower section such that the central section and lower section form in cross section a configuration substantially conforming in shape to the shape of the letter "T", with the lower section having a geometry which conforms to the geometry of the elongated slot in the saddle footing so that a tight fit occurs when the lower section of the modified saddle is inserted into the elongated slot of the saddle footing.

9. A saddle assembly as defined in claim 8 wherein the body of the modified saddle further comprises an upper section including a multiple number of spaced apart members, shaped in the form of posts, mounted upon the central section and conforming in number to the number of strings in the stringed musical instrument in which the saddle assembly is mounted for supporting the strings at an elevated height above the soundboard of the musical instrument.

10. A saddle assembly as defined in claim 9 wherein said central section of the modified saddle comprises a top surface, a plurality of threaded openings spaced apart from one another and aligned parallel to the width of the central section with each threaded opening extending to the top surface thereof, a gear threadably mounted within each threaded opening of the central section with each of the members of the upper section connected to a gear to permit the position of each upper member to be laterally adjusted relative to the central section by manually adjusting each gear in the modified saddle.

11. A saddle assembly as defined in claim 8 wherein the body of the modified saddle further comprises an upper section having a triangular shape in cross section for supporting the strings in the stringed musical instrument at an elevated height above the soundboard of the musical instrument.

12. A saddle assembly as defined in claim 6 wherein the modified bridge or saddle comprises a body having a solid base at the lower end thereof adapted for insertion into the elongated slot in the saddle footing with the solid base being of uniform dimension extending from each opposite end of the modified bridge or saddle and with the geometry of the solid base of the modified bridge or saddle conforming to the geometry of the elongated slot in the saddle footing such that the surface area of the modified bridge or saddle conforms to the surface area of the elongated slot upon engagement therewith.

13. A saddle assembly as defined in claim 12 wherein the stringed musical instrument comprises at least one sound port having a hollow member with a cylindrical geometry extending through the sound board into the interior of the musical instrument for tuning the sound port to a desired frequency range proportional to the resonant frequency of the guitar.

14. A saddle assembly as defined in claim 13 wherein the stringed musical instrument further comprises at least several curved panels having a curvature substantially in the shape of the letter "S" for funneling or venting sound through the sound port.

15. A saddle assembly as defined in claim 12 wherein the stringed musical instrument comprises at least one sound port having a hollow member with a parabolic geometry extending through the sound board into the interior of the musical instrument for tuning the sound port to a desired frequency range proportional to the resonant frequency of the guitar.

16. A saddle assembly for a stringed musical instrument comprising a saddle footing having a body of any desired geometry and a surface curvature compatible with and conforming to the surface curvature of the soundboard of the stringed musical instrument upon which the body of the saddle footing is directly mounted with the body of the saddle footing comprising an upper surface upon which a saddle is mounted for elevating the strings in the stringed musical instrument relative to the soundboard and having at least one conventional transducer pick up incorporated within the saddle footing and a wire cable extending from the transducer pick up for transferring electrical signals, generated from the transducer pick up, corresponding to the vibrations from plucking the strings in the stringed musical instrument, to a pre-amplifier or amplifier.

17. A saddle assembly for a stringed musical instrument as defined in claim 16 wherein the saddle footing has a body adapted for directly mounting a modified bridge or modified saddle upon the saddle footing with the modified saddle bridge or modified saddle including a conventional transducer pick up integrated within the body of the modified bridge or modified saddle, a wire cable extending from the transducer pick up for transferring electrical signals from the transducer pick up to a pre-amplifier or amplifier and with the body of the modified bridge or modified saddle having an upper section mounted upon the body of the modified bridge or modified saddle for supporting the strings in the musical instrument at an elevated height above the soundboard in the musical instrument.

18. A saddle assembly for a stringed musical instrument as defined in claim 17 wherein the saddle footing includes an elongated slot and wherein the modified bridge or modified saddle includes a lower section extending from the body of modified bridge or modified saddle at an end thereof opposite the upper section with the width of the body of the modified bridge or modified saddle being substantially larger than the width of the lower section such that the body of the modified bridge or modified saddle in combination with the lower section forms, in cross section, a configuration substantially conforming in shape to the shape of the letter "T", with the lower section having a geometry which conforms to the geometry of the elongated slot in the saddle footing so that a tight fit occurs when the lower section of the modified bridge or saddle is inserted into the elongated slot of the saddle footing.

19. A saddle assembly for a stringed musical instrument as defined in claim 17 wherein the body of the saddle footing further comprises at least two thumb wheels affixedly mounted upon two corresponding threaded posts extending from the saddle footing and into which each threaded post is threadably connected with the body of said modified saddle bridge or modified saddle being mounted upon said threaded posts such that by manually adjusting the thumb wheels the height of the modified bridge or modified saddle is varied relative to the level of the soundboard of the stringed musical instrument upon which the saddle footing rests.

20. A saddle assembly for a stringed musical instrument as defined in claim 16 wherein the saddle footing includes two conventional transducer pick ups, each said pick up is incorporated within the body of the saddle footing on opposite sides of the elongated slot in the saddle footing.

* * * * *